US009825435B2

(12) United States Patent
Kawai

(10) Patent No.: US 9,825,435 B2
(45) Date of Patent: Nov. 21, 2017

(54) METHOD FOR PRODUCING SPARK PLUG

(71) Applicant: NGK SPARK PLUG CO., LTD., Nagoya-shi, Aichi (JP)

(72) Inventor: Tomoki Kawai, Iwakura (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 6 days.

(21) Appl. No.: 15/111,502

(22) PCT Filed: Jan. 13, 2015

(86) PCT No.: PCT/JP2015/000096
§ 371 (c)(1),
(2) Date: Jul. 14, 2016

(87) PCT Pub. No.: WO2015/107884
PCT Pub. Date: Jul. 23, 2015

(65) Prior Publication Data

US 2016/0344167 A1 Nov. 24, 2016

(30) Foreign Application Priority Data

Jan. 15, 2014 (JP) ..... 2014-004814

(51) Int. Cl.
*H01T 21/02* (2006.01)
*H01T 13/36* (2006.01)

(52) U.S. Cl.
CPC ..... *H01T 21/02* (2013.01); *H01T 13/36* (2013.01)

(58) Field of Classification Search
CPC ..... H01T 21/00–21/06; H01T 13/20–13/39
See application file for complete search history.

(56) References Cited

U.S. PATENT DOCUMENTS

2001/0050522 A1* 12/2001 Nasu ..... H01T 21/02 313/118
2002/0041135 A1* 4/2002 Fukushima ..... H01T 13/36 313/118

(Continued)

FOREIGN PATENT DOCUMENTS

JP 2010-212230 A 9/2010
JP 2013-101805 A 5/2013

OTHER PUBLICATIONS

International Search Report issued in corresponding International Patent Application No. PCT/JP2015/000096, dated Mar. 17, 2015.

(Continued)

*Primary Examiner* — Mariceli Santiago
(74) *Attorney, Agent, or Firm* — Kusner & Jaffe

(57) ABSTRACT

A crimping-pressing step including (1) a step of bringing the crimping jig into contact with a to-be-crimped portion and moving the crimping jig forward such that a load acting on the crimping jig reaches a preset contact load, and (2) a buckling step of further moving the crimping jig forward by a preset distance and then stopping the crimping jig. The difference between the target moving distance of the crimping jig and its actual moving distance is reduced by adjusting at least one of the preset contact load and the preset distance on the basis of at least one of a first overshoot amount in the step (1) and a second overshoot amount in the step (2).

12 Claims, 8 Drawing Sheets

(56) References Cited

U.S. PATENT DOCUMENTS

| | | | | |
|---|---|---|---|---|
| 2002/0067112 | A1* | 6/2002 | Suzuki | H01T 13/36 313/143 |
| 2007/0210688 | A1* | 9/2007 | Suzuki | H01T 21/02 313/141 |
| 2010/0203791 | A1 | 8/2010 | Suzuki et al. | |
| 2011/0107588 | A1* | 5/2011 | Mori | H01T 21/02 29/592.1 |

OTHER PUBLICATIONS

Written Opinion of the International Searching Authority (Form PCT/ISA/237) issued in corresponding International Patent Application No. PCT/JP2015/000096, dated Mar. 5, 2015.

* cited by examiner

FIG. 4(A)
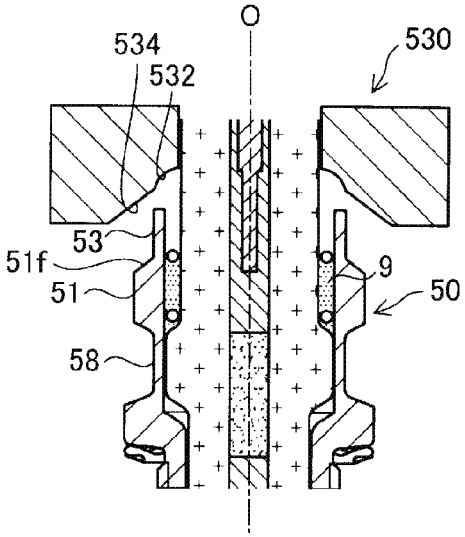
FIG. 4(B)
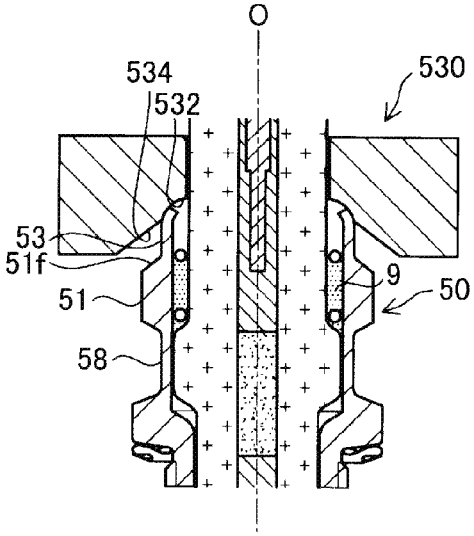
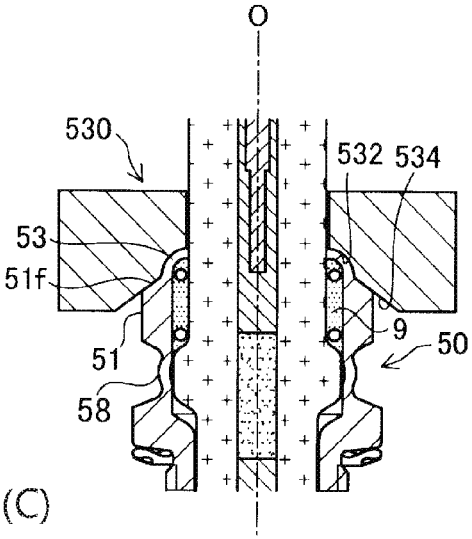
FIG. 4(C)

METHOD FOR PRODUCING SPARK PLUG

RELATED APPLICATIONS

This application is a National Stage of International Application No. PCT/JP2015/000096 filed Jan. 13, 2015, which claims the benefit of Japanese Patent Application No. 2014-004814, filed Jan. 15, 2014.

FIELD OF THE INVENTION

The present invention relates to a method for producing a spark plug.

BACKGROUND OF THE INVENTION

Generally, a spark plug has on its forward end side a center electrode and a ground electrode and has on its rear end side a metallic terminal for receiving power supply. The metallic terminal protrudes from the rear end of an insulator, and the insulator is accommodated and held within a metallic shell. In a spark plug production process, a crimping step is performed, i.e., the insulator is inserted into the tubular metallic shell, and a to-be-crimped portion at the rear end of the metallic shell is crimped to fix the insulator (for example, see Japanese Patent Application Laid-Open (kokai) No. 2013-101805). The metallic shell includes a thick-walled tool engagement portion and a thin-walled to-be-buckled portion (which may be also referred to as a "thin-walled portion") that are disposed forward of the to-be-crimped portion, and the to-be-buckled portion buckles in the crimping step. The crimping step is performed using a crimping press and is therefore referred to also as a "crimping-pressing step."

The amount of buckling of the to-be-buckled portion in the crimping-pressing step is a major factor that determines the state of fixation between the insulator and the metallic shell and the positional relation between the metallic terminal and the metallic shell, so that the amount of buckling has a large influence on the performance (particularly the durability and ignition performance) of the spark plug. Therefore, it is desired to adjust the amount of buckling in the crimping-pressing step to be as close as possible to a predetermined target buckling amount. The amount of buckling depends directly on the amount of movement of a jig of the crimping press (which is referred to as a "crimping jig") that is pressed against the to-be-crimped portion of the metallic shell in the crimping-pressing step. Therefore, it is desired to adjust the moving distance of the crimping jig in the crimping-pressing step to be as close to as possible to a predetermined target moving distance. Particularly, in a small-diameter spark plug in which a so-called insulator mark diameter (the outer diameter of the insulator at the rear end of the metallic shell) is small, the wall thickness of the to-be-crimped portion of the metallic shell is small, so that the above issue is particularly important.

SUMMARY OF THE INVENTION

The present invention has been made to address the foregoing problem and can be embodied in the following modes.

(1) According to one mode of the present invention, there is provided a method for producing a spark plug which includes an insulator and a tubular metallic shell having a to-be-crimped portion at a rear end thereof and having a tool engagement portion and a to-be-buckled portion located forward of the to-be-crimped portion, the method comprising a crimping-pressing step of crimping the to-be-crimped portion using a crimping press, in a state in which the insulator is inserted into the metallic shell, to thereby fix the insulator and buckling the to-be-buckled portion. The crimping-pressing step includes: (1) a step of bringing a crimping jig of the crimping press into contact with the to-be-crimped portion and moving the crimping jig forward such that a load acting on the crimping jig detected by a pressure sensor of the crimping press reaches a preset contact load, and (2) a buckling step of, after the step (1), further moving the crimping jig forward by a preset distance, then stopping the crimping jig, and maintaining the crimping jig in a stopped state. This method is characterized in that a difference between a target moving distance of the crimping jig in a period in which the crimping jig having come into contact with the to-be-crimped portion moves until the crimping jig enters the stopped state and an actual moving distance of the crimping jig in that period is reduced by adjusting at least one of the preset contact load and the preset distance on the basis of at least one of a first overshoot amount by which the crimping jig moves excessively in the step (1) and a second overshoot amount by which the crimping jig moves excessively in the step (2).

In this method, at least one of the preset contact load and the preset distance is adjusted on the basis of at least one of the first overshoot amount and the second overshoot amount to thereby reduce the difference between the target moving distance of the crimping jig and its actual moving distance. Therefore, the moving distance of the crimping jig can be rendered close to the predetermined target moving distance.

(2) In accordance with a second mode of the present invention, in the above-described method, the difference between the target moving distance and the actual moving distance may be reduced by adjusting preset distance which is performed by subtracting, from the preset distance, at least one of a measured value or an estimated value of the first overshoot amount and an estimated value of the second overshoot amount.

In this method, at least one of the first overshoot amount and the second overshoot amount is subtracted from the preset distance, so that the moving distance of the crimping jig can be rendered close to the target moving distance.

(3) In accordance with the third mode of the present invention, in the above-described method, the preset distance adjustment may be performed by subtracting, from the preset distance, the estimated value of the first overshoot amount that is computed from past measured values of the first overshoot amount.

In this method, it is unnecessary to immediately determine the first overshoot amount for each individual workpiece which is being processed in the crimping-pressing step and to perform control processing at high speed.

(4) In accordance with a fourth mode of the present invention, in the above-described method, the estimated value of the first overshoot amount may be an average value computed from past measured values of the first overshoot amount.

With this method, the preset distance can be appropriately adjusted even when variations in the first overshoot amount are considerable.

(5) In accordance with a fifth mode of the present invention, in the above-described method, the estimated value of the first overshoot amount may be determined from an actual moving speed of the crimping jig in the step (1) on the basis of a relation between the moving speed of the crimping jig when the crimping jig comes into contact with the to-be-crimped portion in the step (1) and past measured values of the first overshoot amount.

With this method, the first overshoot amount can be appropriately estimated from the actual moving speed of the crimping jig.

(6) In accordance with a sixth mode of the present invention, in the above-described method, the preset distance adjustment may be performed by subtracting, from the preset distance, the estimated value of the second overshoot amount that is computed from past measured values of the second overshoot amount.

With this method, the preset distance can be appropriately adjusted even when variations in the second overshoot amount are considerable.

(7) In accordance with a seventh mode of the present invention, in the above-described method, the estimated value of the second overshoot amount may be an average value of past measured values of the second overshoot amount.

With this method, the preset distance can be appropriately adjusted even when variations in the second overshoot amount are considerable.

(8) In accordance with an eighth mode of the present invention, in the above-described method, the estimated value of the second overshoot amount may be determined from an actual moving speed of the crimping jig in the step (2) on the basis of a relation between the moving speed of the crimping jig when the crimping jig buckles the to-be-buckled portion in the step (2) and past measured values of the second overshoot amount.

With this method, the second overshoot amount can be appropriately estimated from the actual moving speed of the crimping jig.

(9) In accordance with a ninth mode of the present invention, in the above-described method, an estimated value of an overload acting on the crimping jig may be determined on the basis of past measured values of the overload acting on the crimping jig, the overload corresponding to the first overshoot amount, and the difference between the target moving distance and the actual moving distance may be reduced by adjusting contact load which is performed by subtracting the estimated value of the overload acting on the crimping jig from the preset contact load.

In this method, it is unnecessary to immediately determine the overload OL for each individual workpiece and to perform control processing at high speed.

(10) In accordance with a tenth mode of the present invention, in the above-described method, the estimated value of the overload acting on the crimping jig may be an average value of the past measured values of the overload acting on the crimping jig, the overload corresponding to the first overshoot amount.

With this method, the preset contact load can be appropriately adjusted even when variations in the overload acting on the crimping jig are considerable.

(11) In accordance with an eleventh mode of the present invention, in the above-described method, the estimated value of the overload acting on the crimping jig may be determined from an actual moving speed of the crimping jig in the step (1) on the basis of a relation between the moving speed of the crimping jig when the crimping jig comes into contact with the to-be-crimped portion in the step (1) and the past measured values of the overload acting on the crimping jig, the overload corresponding to the first overshoot amount.

With this method, the overload acting on the crimping jig can be appropriately estimated from the actual moving speed of the crimping jig.

(12) In accordance with a twelfth mode of the present invention, in the above-described method, an outer diameter of the insulator at a rear end of the metallic shell may be 9 mm or less.

With this method, in production of a small-diameter spark plug having an insulator with an outer diameter of 9 mm or less, the moving distance of the crimping jig can be rendered close to the target moving distance.

The present invention can be realized in various forms. For example, the present invention can be realized as a method for producing a spark plug, an apparatus for producing a spark plug, a system for producing a spark plug, etc.

BRIEF DESCRIPTION OF THE DRAWINGS

FIGS. 4(A), 4(B) and 4(C) are illustrations showing the state of a metallic shell and an insulator in the crimping-pressing step.

DETAILED DESCRIPTION OF THE PREFERRED EMBODIMENT

Figure 1:
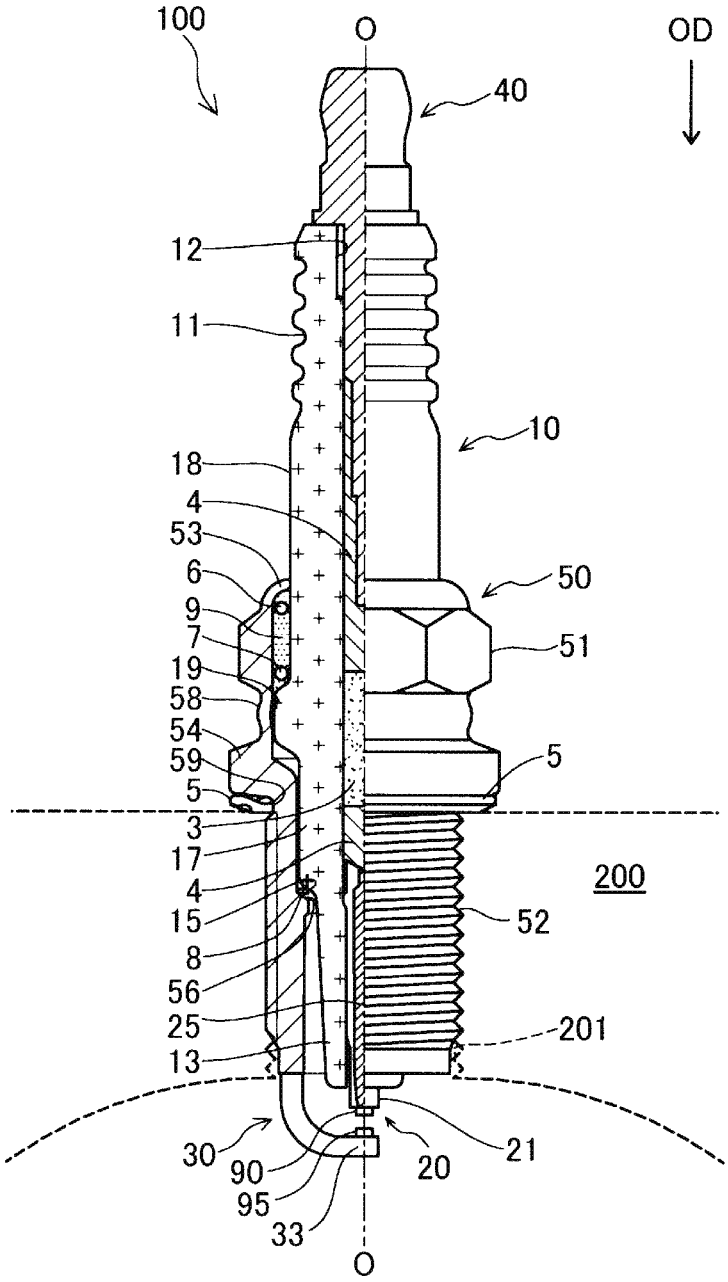
FIG. 1 is an illustration showing the overall structure of a spark plug produced by one embodiment of the present invention.

FIG. 1 is an illustration showing the overall structure of a spark plug 100 produced by one embodiment of the present invention. In FIG. 1, the external appearance of the spark plug 100 is shown on the right side of an axial line O, and a cross section of the spark plug 100 taken along a plane passing through the axial line O is shown on the left side of the axial line O. The lower side (a side toward a spark portion) in FIG. 1 is referred to as the forward end side of the spark plug 100, and the upper side (a side toward a terminal) is referred to as the rear end side. The spark plug 100 includes an insulator 10, a metallic shell 50, a center electrode 20, a ground electrode 30, and a metallic terminal 40.

The insulator 10 is a tubular body having an axial hole 12 extending along the axial line O. A flange portion 19 having the largest outer diameter is formed substantially at the center, with respect to the axial direction OD, of the insulator 10, and a rear trunk portion 18 is formed rearward of the flange portion 19. A corrugated portion 11 (may be also referred to as "corrugations") for enhancing insulation properties through its increased surface length is formed on the rear trunk portion 18. A forward trunk portion 17 smaller in outer diameter than the rear trunk portion 18 is formed forward of the flange portion 19. A leg portion 13 smaller in outer diameter than the forward trunk portion 17 is formed forward of the forward trunk portion 17. The leg portion 13 has an outer diameter decreasing toward the forward end. When the spark plug 100 is mounted on an engine head 200 of an internal combustion engine, the leg portion 13 is exposed to a combustion chamber of the internal combustion engine. A step portion 15 is formed between the leg portion 13 and the forward trunk portion 17.

The center electrode 20 extends from the forward end of the insulator 10 toward its rear end along the axial line O and is exposed at the forward end of the insulator 10. The center electrode 20 is a rod-shaped electrode having a structure in which a core 25 is embedded in an electrode base material 21. The center electrode 20 is electrically connected to the metallic terminal 40 disposed at the rear end of the insulator 10 through a seal 4 and a ceramic resistor 3 within the axial hole 12.

The metallic shell 50 is a tubular metallic member formed of low-carbon steel, and the insulator 10 is accommodated and held inside the metallic shell 50. A portion of the insulator 10 that extends from part of the rear trunk portion 18 to the leg portion 13 is surrounded by the metallic shell 50. The metallic shell 50 has a tool engagement portion 51 and a mounting screw portion 52. The tool engagement portion 51 is a portion to which a spark plug wrench (not shown) is to be fitted. In the present embodiment, the tool engagement portion 51 has a hexagonal shape as viewed in the axial direction OD. The mounting screw portion 52 has a thread that is formed in order to mount the spark plug 100 to the engine head 200 and is to be screwed into a mounting screw hole 201 of the engine head 200 provided in an upper portion of the internal combustion engine.

A flange portion 54 having a flange shape and protruding radially outward is formed between the tool engagement portion 51 and mounting screw portion 52 of the metallic shell 50. An annular gasket 5 formed by bending a plate is fitted to a screw neck 59 between the mounting screw portion 52 and the flange portion 54. The deformation of the gasket 5 provides a seal between the spark plug 100 and the engine head 200, and leakage of combustion gas through the mounting screw hole 201 is thereby suppressed.

A thin-walled to-be-crimped portion 53 is provided rearward of the tool engagement portion 51 of the metallic shell 50. The to-be-crimped portion 53 has been crimped in a crimping-pressing step. An inclined surface 51*f* is formed at a position located rearward of the tool engagement portion 51 and forward of the to-be-crimped portion 53. A thin-walled to-be-buckled portion 58 is provided between the flange portion 54 and the tool engagement portion 51. Annular ring members 6 and 7 are inserted between the inner circumferential surface of the metallic shell 50 that extends from the tool engagement portion 51 to the to-be-crimped portion 53 and the outer circumferential surface of the rear trunk portion 18 of the insulator 10. A space between these ring members 6 and 7 is filled with powder of talc 9 that serves as a filler for maintaining airtightness. In the crimping-pressing step described later, a crimping jig of a crimping press is used to bend the to-be-crimped portion 53 inwardly to thereby crimp the to-be-crimped portion 53, whereby the metallic shell 50 is fixed to the insulator 10. In addition, in the crimping-pressing step, the to-be-buckled portion 58 is buckled. The crimping-pressing step may be performed as cold working or as hot working. The airtightness between the metallic shell 50 and the insulator 10 is maintained by an annular sheet packing 8 interposed between a step portion 56 formed on the inner circumferential surface of the metallic shell 50 and the step portion 15 of the insulator 10, and leakage of combustion gas is thereby prevented. The to-be-buckled portion 58 is configured so as to bend and deform outward when a compressive force is applied thereto during crimping, so that the compressible length of the talc 9 is ensured to thereby improve the airtightness in the metallic shell 50. In the present specification, the thin-walled portion which is located at the rear end of the metallic shell 50 and which is to be subjected to crimping is referred to as the "to-be-crimped portion 53" both before and after the crimping-pressing step. The thin-walled portion which is located forward of the tool engagement portion 51 and which is to be buckled in the crimping-pressing step is referred to as the "to-be-buckled portion 58" both before and after the crimping-pressing step.

The bent ground electrode 30 is joined to the forward end of the metallic shell 50. A distal end 33 of the ground electrode 30 faces the center electrode 20. Noble metal tips 90 and 95 are attached to the center electrode 20 and the ground electrode 30, respectively. However, the noble metal tips 90 and 95 may be omitted.

Figure 2:
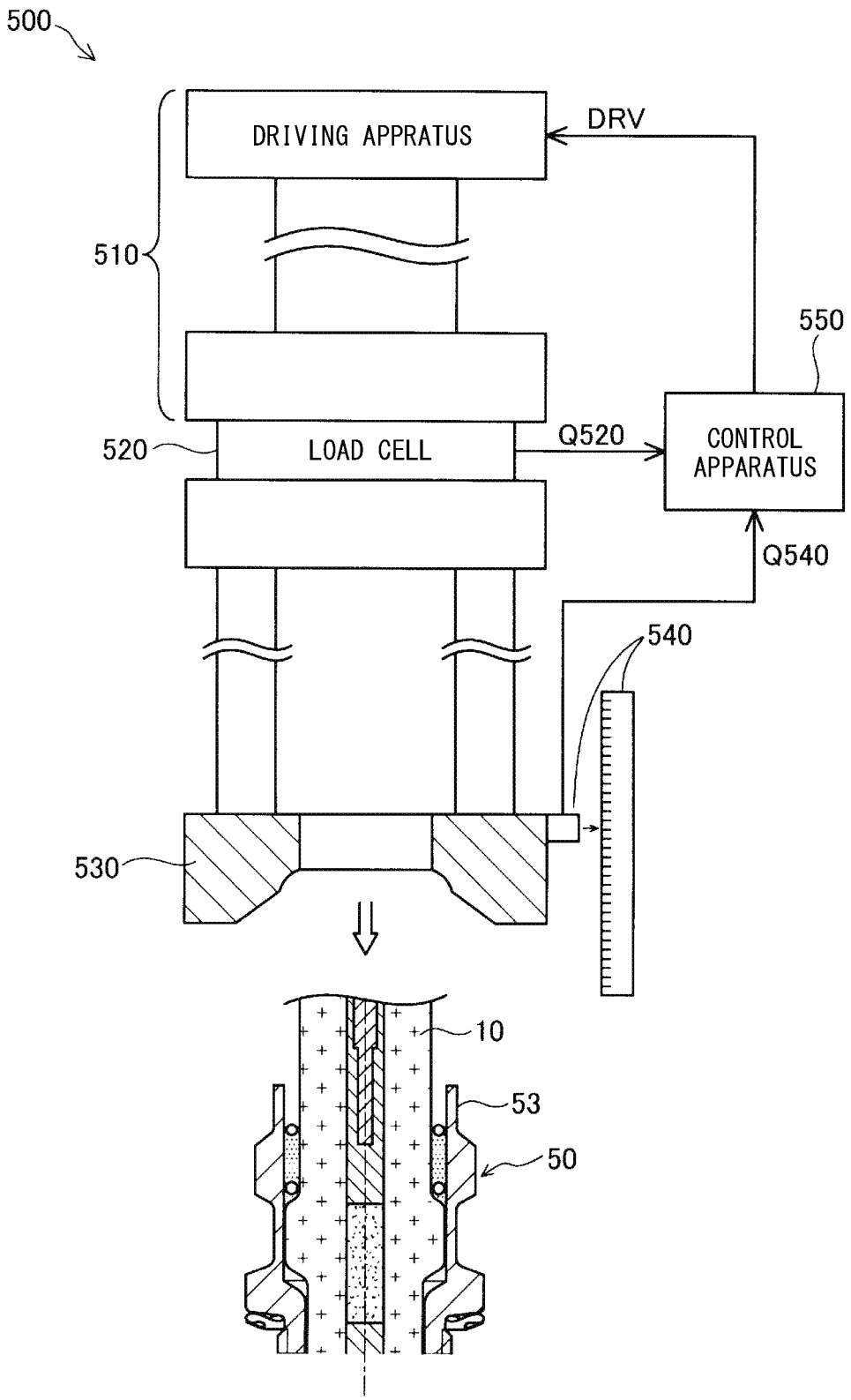
FIG. 2 is an illustration showing an exemplary structure of a crimping press.

FIG. 2 is an illustration showing an exemplary structure of a crimping press used in the crimping-pressing step for the spark plug 100. This crimping press 500 includes a driving apparatus 510, a load cell (load sensor) 520, a crimping jig 530, a linear scale (position sensor) 540, and a control apparatus 550. The crimping jig 530 can be vertically moved by the driving apparatus 510 and presses downward the to-be-crimped portion 53 disposed at the rear end of the metallic shell 50. The load applied to the crimping jig 530 is measured by the load cell 520. The vertical moving distance of the crimping jig 530 is measured by the linear scale 540. The output Q520 of the load cell 520 (the load acting on the crimping jig 530) and the output Q540 of the linear scale 540 (the position of the crimping jig 530) are sent to the control apparatus 550. The control apparatus 550 supplies a driving signal DRV to the driving apparatus 510 to move the crimping jig 530 vertically. As described later, the control apparatus 550 can appropriately modify the driving signal DRV using the outputs Q520 and Q540 from the sensors 520 and 540.

Figure 3:
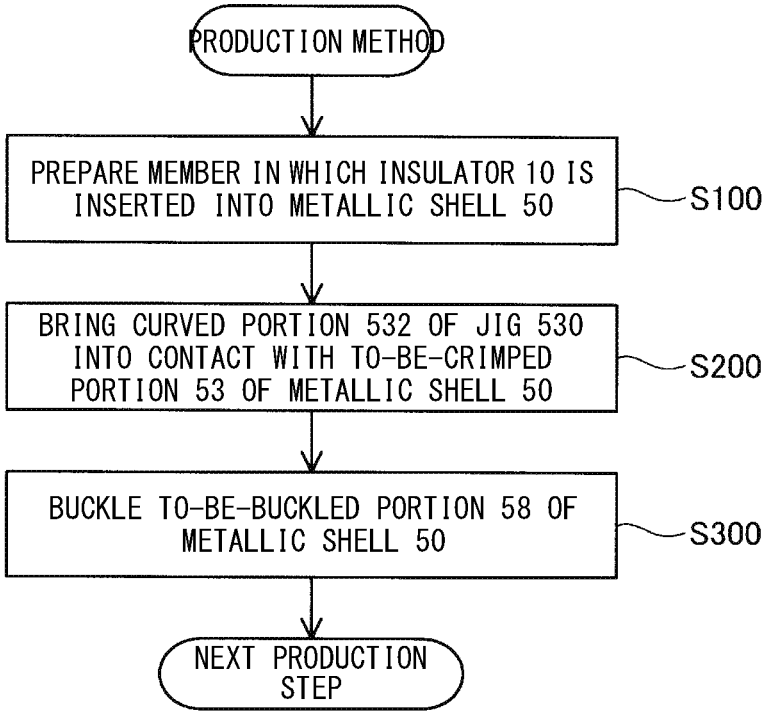
FIG. 3 is a flowchart showing the procedure of a crimping-pressing step.

FIG. 3 is a flowchart showing the procedure of the crimping-pressing step in the process of producing the spark plug. FIG. 4 is a set of illustrations showing the state of the metallic shell 50 and the insulator 10 in the crimping-pressing step.

In step S100 (FIG. 3), before the step of fixing the metallic shell 50 to the insulator 10, a member including the metallic shell 50 and the insulator 10 inserted therein (this member may be also referred to as a "workpiece") is prepared (FIG. 4(A)). The crimping jig 530 has a tubular shape and has a tapered surface 534 formed so as to be tapered and a curved portion 532 formed rearward of the tapered surface 534.

In step S200, the curved portion 532 of the crimping jig 530 is brought into contact with the to-be-crimped portion 53 of the metallic shell 50 (FIG. 4(B)). At that time, the tapered surface 534 of the crimping jig 530 is not in contact with the inclined surface 51*f* of the metallic shell 50, and the to-be-crimped portion 53 of the metallic shell 50 is deformed slightly from the forward end.

In step S300, the crimping jig 530 is further moved forward to buckle the to-be-buckled portion 58, and this state is maintained for a prescribed time (FIG. 4(C)). At that time, the tapered surface 534 of the crimping jig 530 is in contact with the inclined surface 51*f* of the metallic shell 50 and strongly presses the metallic shell 50 downward, so that the to-be-buckled portion 58 can be buckled. After completion of step S300, the crimping jig 530 is moved rearward to release the workpiece (the insulator 10 and the metallic shell 50). Then there is performed the subsequent production step such as the step of bending the ground electrode 30 such that it faces the center electrode 20.

Figure 5:
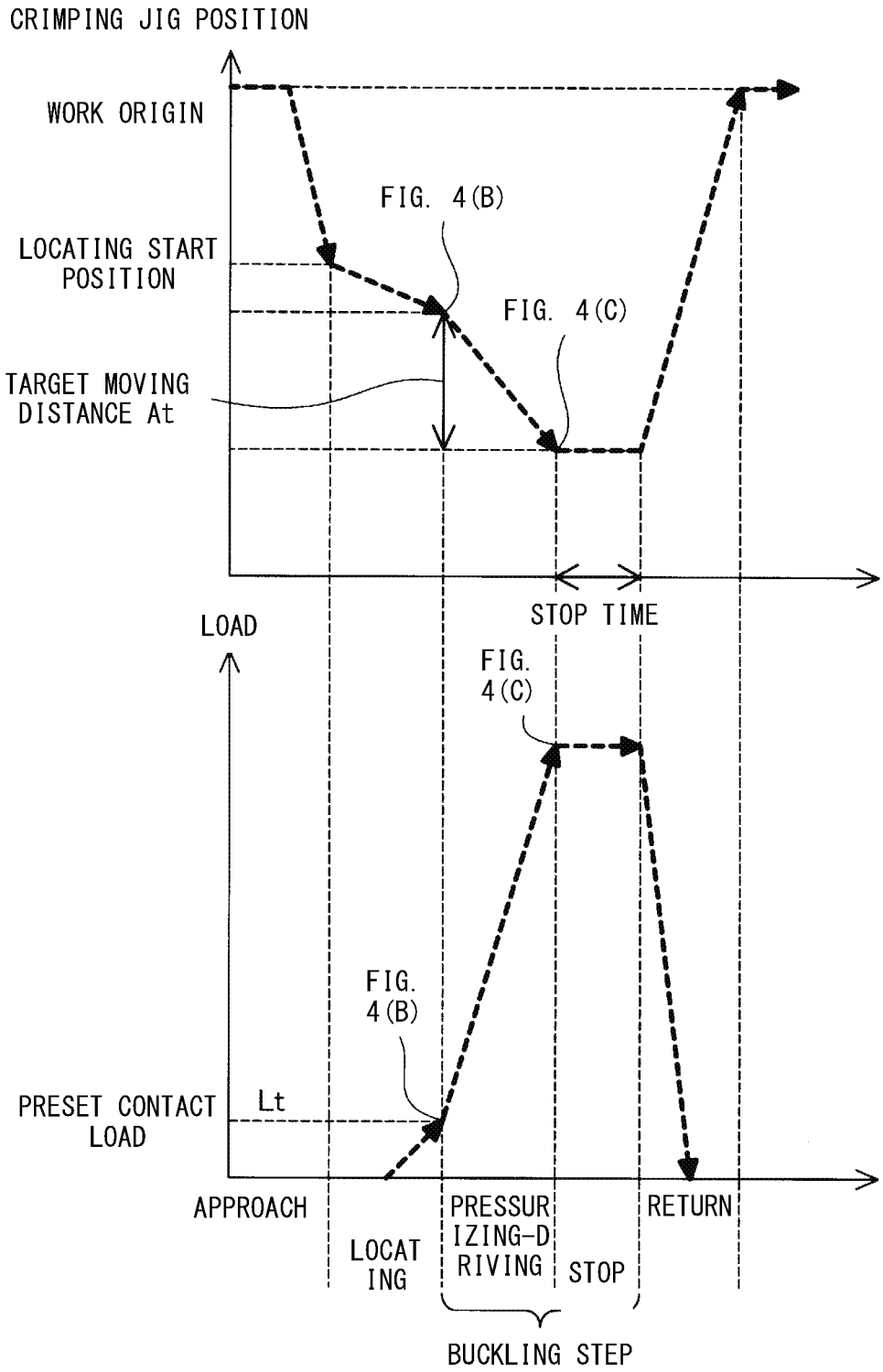
FIG. 5 is a graph showing the vertical position of a crimping jig and changes in load in an ideal crimping-pressing step.

FIG. 5 is a graph showing the vertical position of the crimping jig 530 and changes in load in an ideal crimping-pressing step. The horizontal axis represents time elapsed and is divided into the following five steps in this example. (1) Approach step: In this step, the crimping jig 530 is moved at high speed from a work origin, which is a retracted position above the workpiece (the insulator 10 and the metallic shell 50), to a position (a locating start position) just before a position where the crimping jig 530 comes into contact with the workpiece. (2) Locating step: In this step, the crimping jig 530 is moved at low speed and brought into contact with the to-be-crimped portion 53 of the metallic shell 50. During the locating step, the crimping jig 530 comes into contact with the to-be-crimped portion 53. The endpoint of the locating step corresponds to the state in FIG. 4(B), and the load (contact load) detected by the load cell 520 has reached a preset contact load Lt set in advance. The preset contact load Lt is a load used to detect a state in which the crimping jig 530 is in contact with the to-be-crimped portion 53 and is set to a value slightly larger than zero. (3) Pressurizing-driving step: In this step, the crimping jig 530 is further moved forward (downward in FIG. 2) at a speed faster than that in the locating step to thereby crimp the to-be-crimped portion 53 and buckle the to-be-buckled portion 58. The crimping jig 530 does not stop at the endpoint of the locating step, and the process enters the pressurizing-driving step with no break. In the pressurizing-driving step, the crimping jig 530 is moved by a target moving distance At set in advance. The endpoint of the pressurizing-driving step corresponds to the state in FIG. 4(C). The "target moving distance At" is the target value of the moving distance of the crimping jig 530 in the pressurizing-driving step. The "target moving distance At" is the target value of the moving distance of the crimping jig 530 in a period in which the crimping jig 530 having come into contact with the to-be-crimped portion 53 in the locating step moves until the crimping jig 530 stops at the end of the pressurizing-driving step. Specifically, in the ideal operation, the amount of excessive movement in the locating step (a first overshoot amount described later) is zero, and therefore the target moving distance At in the pressurizing-driving step alone is equal to the target moving distance At over the locating step and the pressurizing-driving step. In an actual operation described later, it is desirable to adjust the actual moving distance to be as close as possible to the "target moving distance At" in the ideal operation. (4) Stop step: In this step, the crimping jig 530 is maintained in a stopped state to allow the to-be-buckled portion 58 to be buckled reliably. The pressurizing-driving step and stop step described above may be collectively referred to as a "buckling step." (5) Return step: In this step, the crimping jig 530 is moved rearward to the work origin to release the workpiece.

By performing the crimping-pressing step including these five steps, the to-be-crimped portion 53 can be crimped, and the to-be-buckled portion 58 can be buckled. It is possible to buckle the to-be-buckled portion 58 by a target buckling amount set in advance.

Figure 6:
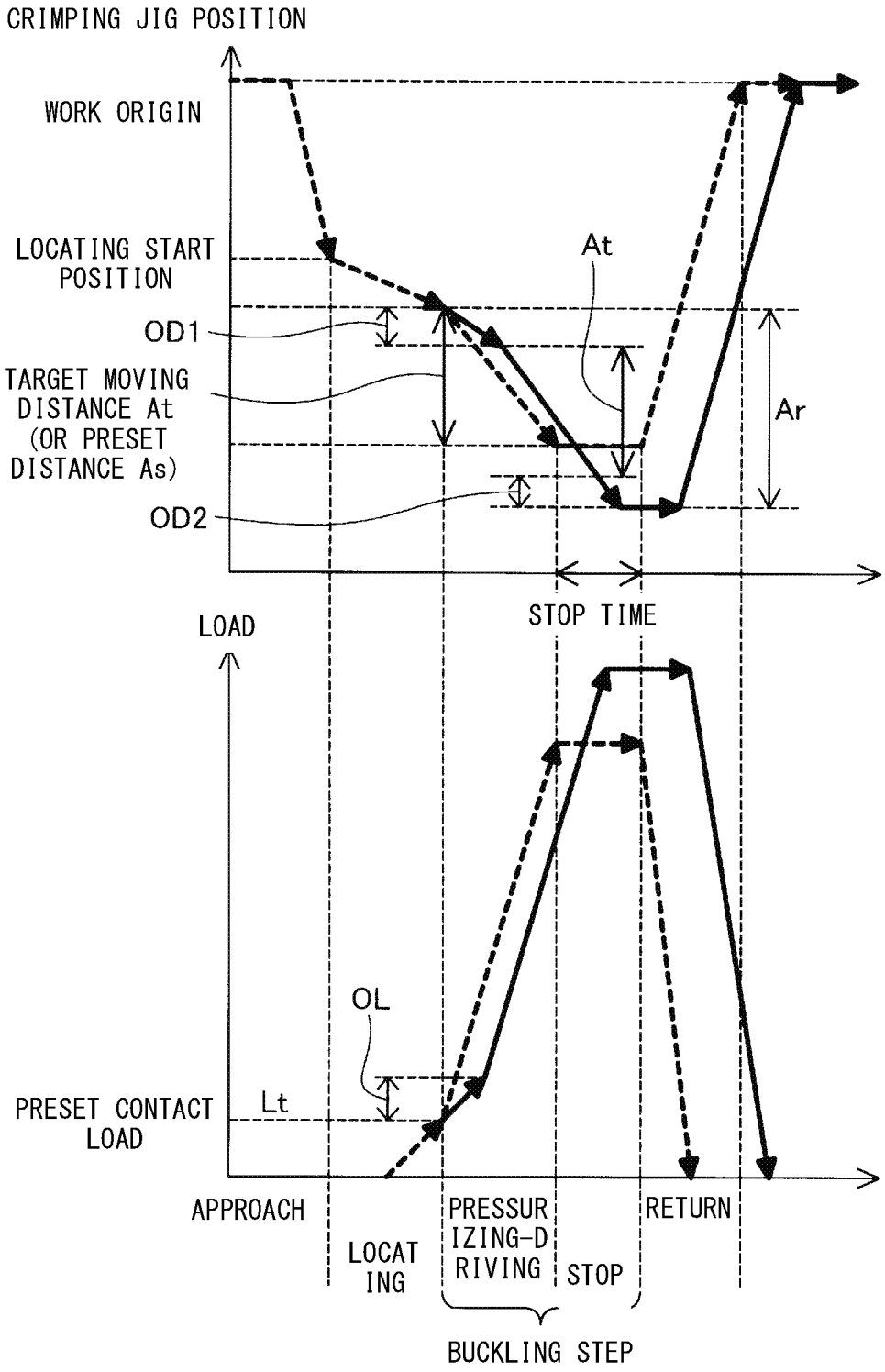
FIG. 6 is a graph showing the vertical position of the crimping jig and changes in load in an actual crimping-pressing step.

FIG. 6 is a graph showing the vertical position of the crimping jig 530 and changes in load in an actual crimping-pressing step. In this graph, the ideal operation is drawn by broken lines, and the actual operation deviating from the ideal operation is drawn by solid lines. In the vicinity of the endpoint of the actual locating step, the locating step does not end at a position where the load acting on the crimping jig 530 becomes equal to the preset contact load Lt, and the process proceeds from the locating step to the pressurizing-driving step at a position where the load acting on the crimping jig 530 becomes larger than the preset contact load Lt by an overload OL. This overload OL may be also referred to as an "overshoot load OL." At the endpoint of the actual locating step, the position of the crimping jig 530 may reach a position ahead of the endpoint of the locating step in the ideal operation by a small distance OD1. The distance OD1 of the excessive movement is a distance corresponding to the overload OL and is also referred to as a "first overshoot amount OD1." In FIG. 6, broken lines representing the boundaries between steps are for the ideal operation. In the actual operation, the boundaries between steps deviate from these broken lines.

In the pressurizing-driving step subsequent to the locating step, the driving apparatus 510 moves the crimping jig 530 by the target moving distance At set in advance. However, at the endpoint of the actual pressurizing-driving step, the crimping jig 530 may fail to stop at a position shifted from the start position of the pressurizing-driving step by the target moving distance At and may reach a position ahead of the above position by a small distance OD2. This excessive movement may also occur when a preset distance As in the pressurizing-driving step (a preset value in the control apparatus 550) is set to a value slightly smaller than the target moving distance At. In these cases, the excessive movement OD2 in the pressurizing-driving step, i.e., a value OD2 obtained by subtracting the target moving distance At from the actual moving distance in the pressurizing-driving step, is referred to as a "second overshoot distance OD2" or a "second overshoot amount OD2." Then the same stop step and return step as those in the ideal operation are performed, and the crimping-pressing step is thereby completed.

If the above-described two types of overshoots whose overshoot amounts are OD1 and OD2 occur in the actual locating step and the actual pressurizing-driving step, the actual moving distance Ar of the crimping jig 530 in the period in which the crimping jig 530 having come into contact with the to-be-crimped portion 53 moves until the endpoint of the pressurizing-driving step is larger than the target moving distance At by the sum of these overshoot amounts OD1 and OD2 (OD1+OD2). As a result, the amount of buckling of the to-be-buckled portion 58 may be considerably larger than the target buckling amount set in advance. This problem also occurs when only one of the two types of overshoots (whose amounts are OD1 and OD2) occurs (the other one is negligibly small).

Accordingly, in the present embodiment, at least one of the preset contact load Lt in the locating step and the preset distance As in the pressurizing-driving step is adjusted on the basis of at least one of the first overshoot amount OD1 and the second overshoot amount OD2. This adjustment can reduce the difference between the target moving distance At of the crimping jig 530 in the period in which the crimping jig 530 having come into contact with the to-be-crimped portion 53 moves until the crimping jig 530 enters the stop step and the actual moving distance Ar of the crimping jig 530 in that period. As a result, the actual buckling amount of the to-be-buckled portion 58 can be rendered close to the target buckling amount set in advance. Specific adjustment methods are, for example, as follows.

Methods for Adjusting Preset Distance as (1) Preset distance adjustment method 1: A measured value of the first overshoot amount OD1 in the locating step is subtracted from the preset distance As in the pressurizing-driving step immediately after the locating step to determine a new preset distance (As−OD).

"The measured value of the first overshoot amount OD1" means the distance OD1 corresponding to the overload OL in the locating step (FIG. 6). Specifically, the measured value of the first overshoot amount OD1 is determined as the difference between a first measured value of the linear scale 540 when the load measured by the load cell 520 reaches the preset contact load Lt and a second measured value of the linear scale 540 when the load reaches the overload OL. The preset distance As before the adjustment is generally set to a value equal to the target moving distance At or to a value slightly smaller than the target moving distance At.

Figure 7A:
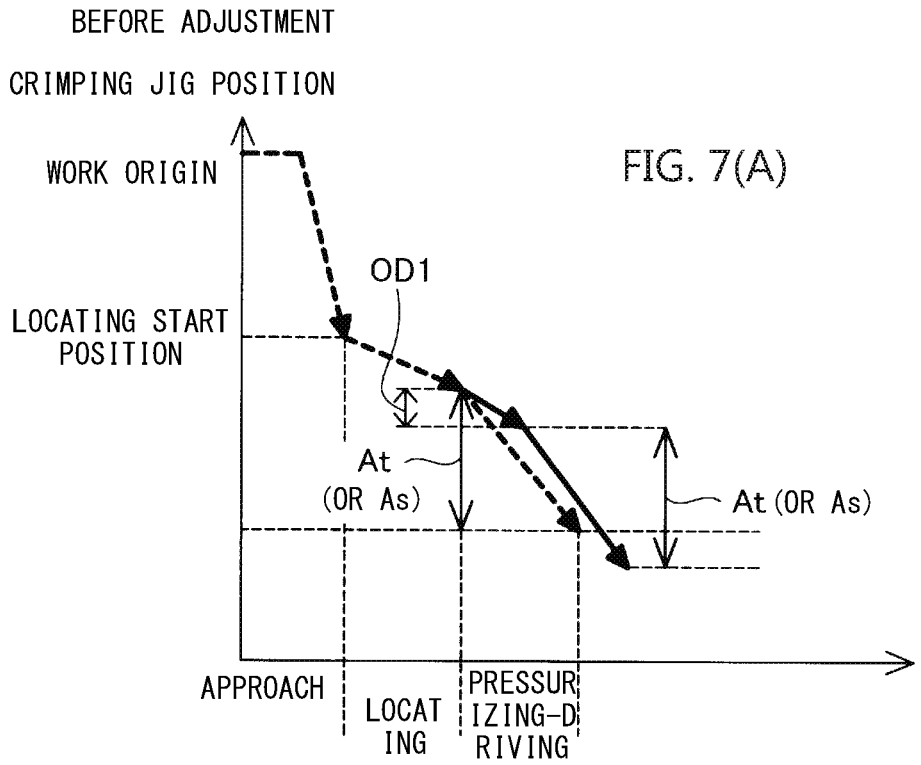
FIGS. 7(A) and 7(B) are graphs showing operation in a preset distance adjustment method 1.
Figure 7B:
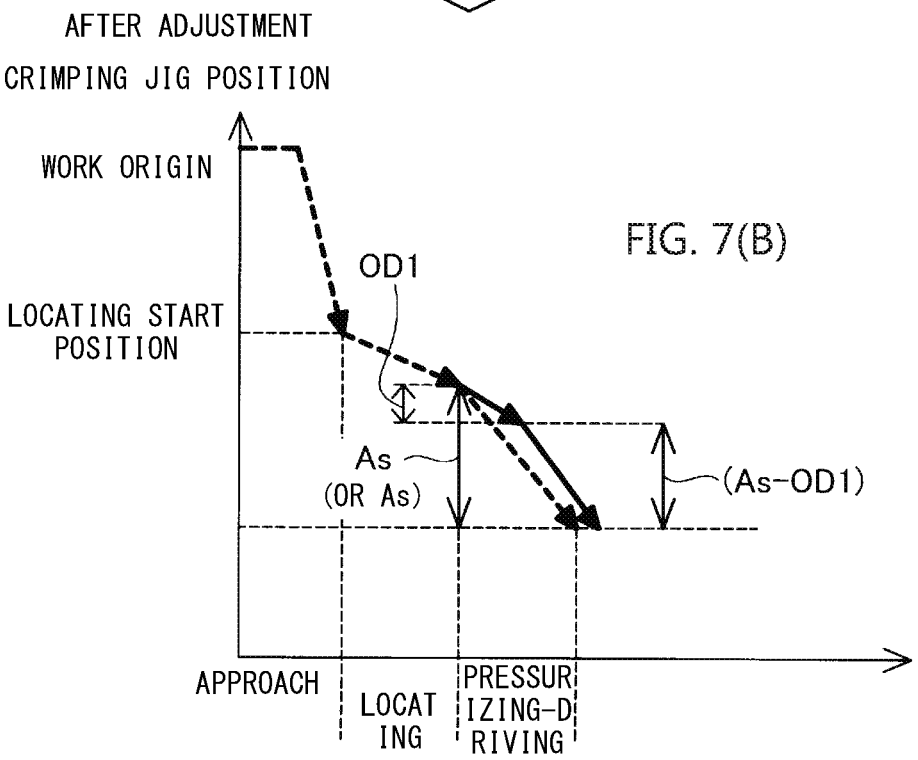

FIG. 7(A) shows the operation before adjustment by the preset distance adjustment method 1, and FIG. 7(B) shows the operation after the adjustment. In FIGS. 7(A) and 7(B), only the operation until the pressurizing-driving step is drawn for illustrative convenience. The operation before the adjustment is the same as that shown in FIG. 6. In the operation after the adjustment, a value obtained by subtracting the measured value of the first overshoot amount OD1 from the preset distance As in the pressurizing-driving step (As−OD1) is used as a new preset distance, and then the pressurizing-driving step is performed on the workpiece. In the crimping-pressing step for each individual workpiece in the preset distance adjustment method 1, the measured value of the first overshoot amount OD1 in the locating step is subtracted from the preset distance As in the pressurizing-driving step immediately after the locating step. Therefore, the influence of the first overshoot amount OD1 on each individual workpiece can be eliminated, and the actual moving distance of the crimping jig 530 can be rendered close to the target moving distance At. However, in the preset distance adjustment method 1, a press facility capable of fast processing is used so that the control apparatus 550 that has received the outputs Q520 and Q540 from the sensors 520 and 540 can immediately supply a driving signal DRV indicating the adjusted preset distance (As−OD1) to the driving apparatus 510.

(2) Preset distance adjustment method 2: An average value OD1ave computed from past measured values of the first overshoot amount OD1 in the locating step is subtracted from the preset distance As to determine a new preset distance (As−OD1ave).

Preferably, "the average value OD1ave" used is an average value computed from measured values for workpieces (insulators 10 and metallic shells 50) for spark plugs with the same part number (or the same model number). Particularly, it is preferable to use the average value over the most recent prescribed time period (e.g., the latest one-hour period) or the average value for the prescribed number of most recent workpieces (e.g., the latest 20 workpieces). These are so called "moving averages" and can be used as appropriate average values reflecting changes in the environment of the crimping-pressing step. The same applies to other adjustment methods (described later) that use past measured values and averages thereof. With the preset distance adjustment method 2, the preset distance As can be appropriately adjusted even when variations in the first overshoot amount OD1 are considerable. In addition, it is unnecessary to immediately determine the first overshoot amount OD1 for each individual workpiece and to perform the control processing at high speed. Therefore, even when the response of the press facility and the processing speed of the control apparatus 550 are slow, the present distance can be adjusted appropriately. However, since the preset distance adjustment method 2 cannot be used for workpieces for spark plugs of a different part number (or a different model number), it is preferable to use another adjustment method until measured values for a certain number of workpieces are obtained. The same applies to other adjustment methods (described later) that use past measured values and averages thereof.

(3) Preset distance adjustment method 3: An estimated value OD1pre of the first overshoot amount OD1 is determined from the actual moving speed of the crimping jig 530 in the locating step on the basis of the relation between the moving speed of the crimping jig 530 when the crimping jig 530 comes into contact with the to-be-crimped portion 53 in the locating step and past measured values of the first overshoot amount OD1. This estimated value OD1pre is subtracted from the preset distance As to thereby determine a new preset distance (As−OD1pre).

Figure 8:
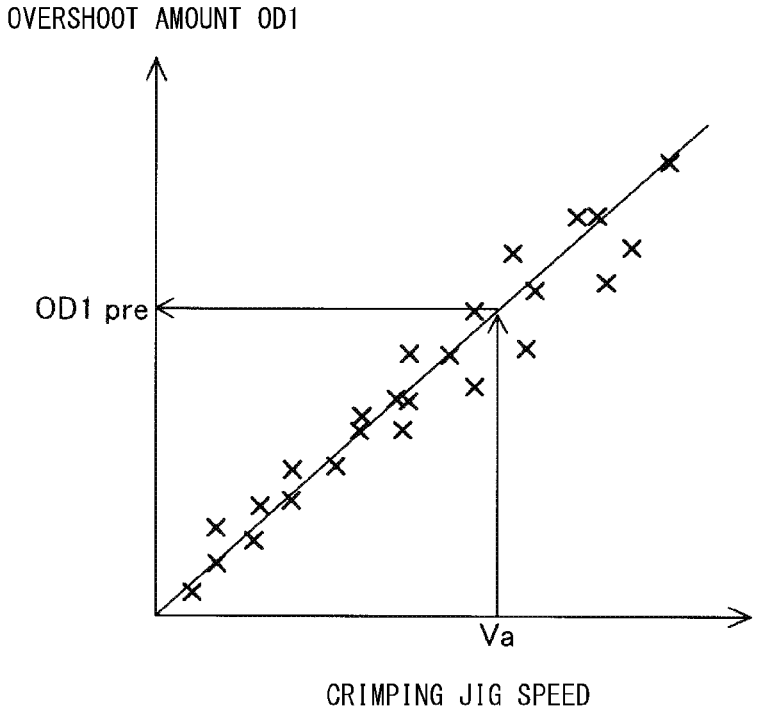
FIG. 8 is a graph showing an example of a method for determining an estimated value of an overshoot amount in a preset distance adjustment method 3.

FIG. 8 is a graph showing an example of the method for determining the estimated value OD1pre of the overshoot amount OD1 in the preset distance adjustment method 3. The horizontal axis of FIG. 8 represents the moving speed of the crimping jig 530 when the crimping jig 530 comes into contact with the to-be-crimped portion 53 in the locating step, and the vertical axis represents the first overshoot amount OD1. "X" marks in the graph represent past measured values. In this example, the estimated value OD1pre of the first overshoot amount OD1 is determined from the actual moving speed Va of the crimping jig 530 in the locating step for each individual workpiece. With the preset distance adjustment method 3, the first overshoot amount OD1 can be appropriately estimated from the actual moving speed of the crimping jig 530. It is unnecessary to immediately determine the first overshoot amount OD1 for each individual workpiece and to perform the control processing at high speed. Therefore, even when the response of the press facility and the processing speed of the control apparatus 550 are slow, the present distance can be adjusted appropriately.

The average value OD1ave of the first overshoot amount OD1 used in the preset distance adjustment method 2 described above can be considered as one type of estimated value of the actual first overshoot amount OD1. In this regard, the preset distance adjustment methods 2 and 3 have a commonality. Specifically, in both the methods, the estimated value computed from past measured values of the first overshoot amount OD1 is subtracted from the preset distance As to determine a new preset distance.

(4) Preset distance adjustment method 4: An average value OD2ave computed from past measured values of the second overshoot amount OD2 in the pressurizing-driving step is subtracted from the preset distance As to determine a new preset distance (As−OD2ave).

In this preset distance adjustment method 4, "the average value OD1ave computed from the past measured values of the first overshoot amount OD1" in the preset distance adjustment method 2 described above is replaced by "the average value OD2ave computed from the past measured values of the second overshoot amount OD2." Therefore, the preset distance adjustment method 4 has the same effects as those in the preset distance adjustment method 2 described above. In addition, the preset distance adjustment method 4 can be modified in the same manner as in the preset distance adjustment method 2.

(5) Preset distance adjustment method 5: An estimated value OD2pre of the second overshoot amount OD2 is determined from the actual moving speed of the crimping jig 530 in the pressurizing-driving step on the basis of the relation between the moving speed of the crimping jig 530 when the crimping jig 530 buckles the to-be-buckled portion 58 in the pressurizing-driving step and past measured values of the second overshoot amount OD2. Then this estimated value OD2pre is subtracted from the preset distance As to determine a new preset distance (As−OD2pre). In the preset distance adjustment method 5, "the estimated value OD1pre of the first overshoot amount OD1" in the preset distance adjustment method 3 described above is replaced by "the estimated value OD2pre of the second overshoot amount OD2." Therefore, the preset distance adjustment method 5 has the same effects as those in the preset distance adjustment method 3 described above. In addition, the preset distance adjustment method 5 can be modified in the same manner as in the preset distance adjustment method 3.

The average value OD2ave of the second overshoot amount OD2 used in the preset distance adjustment method 4 described above can be considered as one type of estimated value of the actual second overshoot amount OD2. In this regard, the preset distance adjustment methods 4 and 5 have a commonality. Specifically, in both the methods, the estimated value computed from past measured values of the second overshoot amount OD2 is subtracted from the preset distance As to determine a new preset distance.

Generally, the first overshoot amount OD1 is larger than the second overshoot amount OD2. Therefore, it is expected that the preset distance adjustment methods 2 and 3 that use the first overshoot amount OD1 are more effective than the preset distance adjustment methods 4 and 5 that use the second overshoot amount OD2.

Among the above-described five preset distance adjustment methods 1 to 5, the first three preset distance adjustment methods 1 to 3 have a commonality in that the measured or estimated value of the first overshoot amount OD1 is subtracted from the preset distance As. The other two preset distance adjustment methods 4 and 5 have a commonality in that the estimated value OD2pre of the second overshoot amount OD2 is subtracted from the preset distance As. The first overshoot amount OD1 and the second overshoot amount OD2 occur independently. Therefore, one of the preset distance adjustment methods 1 to 3 that use the measured or estimated value of the first overshoot amount OD1 and one of the preset distance adjustment methods 4 and 5 that use the estimated value of the second overshoot amount OD2 may be used in combination to adjust the preset distance As. For example, the preset distance adjustment methods 1 and 4 may be used in combination. In this case, both the measured value of the first overshoot amount OD1 in the locating step and the average value OD2ave computed from the past measured values of the second overshoot amount OD2 in the pressurizing-driving step are subtracted from the preset distance As to determine a new preset distance (As−OD1−OD2ave). In this manner, the difference between the target moving distance At and actual moving distance of the crimping jig 530 can be further reduced. With consideration given to various combinations of preset distance adjustment methods, an adjustment method can be used, in which at least one of the measured or estimated value of the first overshoot amount OD1 and the estimated value of the second overshoot amount OD2 is subtracted from the preset distance As to reduce the difference between the target moving distance At and actual moving distance of the crimping jig 530.

Methods for Adjusting Preset Contact Load Lt (1) Preset contact load adjustment method 1: An average value OLave computed from past measured values of the overload OL acting on the crimping jig 530 that corresponds to the first overshoot amount OD1 in the locating step is subtracted from the preset contact load Lt to determine a new preset contact load (Lt−OLave).

Preferably, "the average value OLave" used is an average value computed from measured values for workpieces (insulators 10 and metallic shells 50) for spark plugs with the same part number (or the same model number). Particularly, it is preferable to use the average value over the most recent prescribed time period (e.g., the latest one-hour period) or the average value for the prescribed number of most recent workpieces (e.g., the latest 20 workpieces). With the preset contact load adjustment method 1, the preset contact load Lt can be appropriately adjusted even when variations in the overload OL acting on the crimping jig 530 are considerable. In addition, it is unnecessary to immediately determine the overload OL for each individual workpiece and to perform the control processing at high speed. Therefore, even when the response of the press facility and the processing speed of the control apparatus 550 are slow, the preset contact load can be adjusted appropriately. However, since the preset contact load adjustment method 1 cannot be used for workpieces for spark plugs of a different part number (or a different model number), it is preferable to use another adjustment method until measured values for a certain number of workpieces are obtained.

(2) Preset contact load adjustment method 2: An estimated value OLpre of the overload OL acting on the crimping jig 530 is determined from the actual moving speed of the crimping jig 530 in the locating step on the basis of the relation between the moving speed of the crimping jig 530 when the crimping jig 530 comes into contact with the to-be-crimped portion 53 in the locating step and past measured values of the overload OL corresponding to the first overshoot amount OD1. This estimated value OLpre is subtracted from the preset contact load Lt to determine a new preset contact load (Lt−OLpre).

Figure 9:
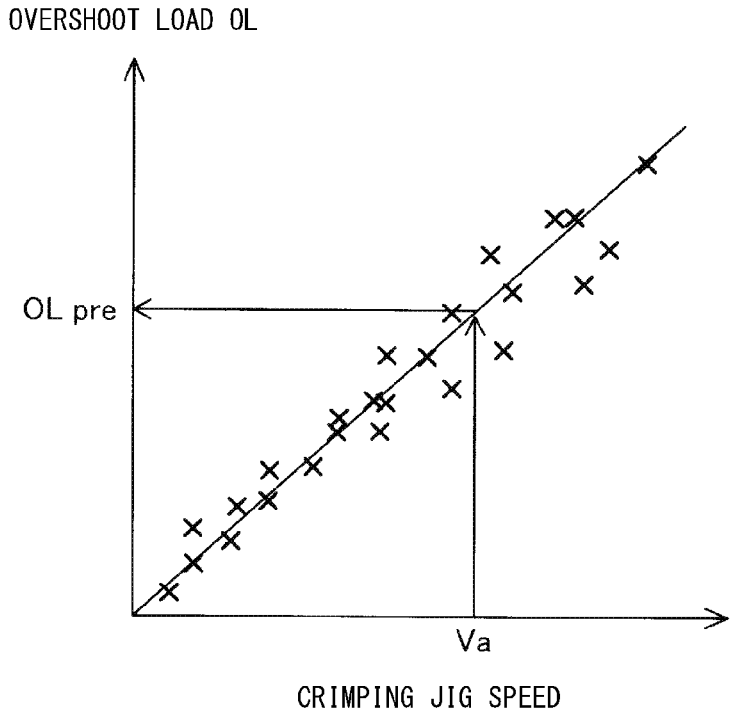
FIG. 9 is a graph showing an example of a method for determining an estimated value of an overshoot load in a preset contact load adjustment method 2.

FIG. 9 is a graph showing an example of the method for determining the estimated value OLpre of the overshoot load OL in the preset contact load adjustment method 2. The horizontal axis of FIG. 9 represents the moving speed of the crimping jig 530 when the crimping jig 530 comes into contact with the to-be-crimped portion 53 in the locating step, and the vertical axis represents the overshoot load OL. "X" marks in the graph represent past measured values. In this example, the estimated value OLpre of the overshoot load OL is determined from the actual moving speed Va of the crimping jig 530 in the locating step for each individual workpiece. With the preset contact load adjustment method 2, the actual overshoot load OL can be appropriately estimated, so that the preset contact load can be appropriately adjusted. Therefore, the actual moving distance of the crimping jig 530 can be rendered close to the target moving distance At. It is unnecessary to immediately determine the overload OL for each individual workpiece and to perform the control processing at high speed. Therefore, even when the response of the press facility and the processing speed of the control apparatus 550 are slow, the preset contact load can be adjusted appropriately.

The average value OLave of the overshoot load OL used in the preset contact load adjustment method 1 described above can be considered as one type of estimated value of the accrual overshoot load OL. In this regard, the preset distance adjustment methods 1 and 2 have a commonality.

Specifically, in both the methods, the estimated value computed from past measurement values of the overshoot load OL is subtracted from the preset contact load Lt to determine a new preset contact load.

One of the preset contact load adjustment methods 1 and 2 and one of the above-described preset distance adjustment methods 4 and 5 in which the estimated value OD2pre of the second overshoot amount OD2 is subtracted from the preset distance As can be combined appropriately. For example, the preset contact load adjustment method 1 may be used to determine a new preset contact load (Lt−OLave) by subtracting, from the preset contact load Lt, the average value OLave computed from the past measured values of the overload OL acting on the crimping jig 530 that corresponds to the first overshoot amount OD1 in the locating step. In addition, the preset distance adjustment method 4 may be used to determine a new preset distance (As−OD2ave) by subtracting, from the preset distance As, the average value OD2ave computed from the past measured values of the second overshoot amount OD2 in the pressurizing-driving step. In this manner, the difference between the target moving distance At and actual moving distance of the crimping jig 530 can be further reduced. Therefore, in the present embodiment, at least one of the preset contact load Lt in the locating step and the preset distance As in the pressurizing-driving step can be adjusted on the basis of at least one of the first overshoot amount OD1 and the second overshoot amount OD2. This adjustment can reduce the difference between the target moving distance At of the crimping jig 530 in the period in which the crimping jig 530 having come into contact with the to-be-crimped portion 53 moves until the crimping jig 530 enters the stop step and the actual moving distance of the crimping jig 530 in that period. As a result, the actual buckling amount of the to-be-buckled portion 58 can be rendered close to the target buckling amount set in advance.

The deviation from the target moving distance At of the crimping jig 530 and the deviation from the target buckling amount of the to-be-buckled portion 58 in the crimping-pressing step are important particularly for a small-diameter spark plug having a small insulator mark diameter (the outer diameter of the insulator 10 at the rear end of the metallic shell 50). The reason for this is that, in the spark plug with a small insulator mark diameter, the to-be-crimped portion 53 has a small wall thickness and therefore the deviation from the target moving distance At and the deviation from the target buckling amount of the to-be-buckled portion 58 tend to become large. In this regard, it is preferable that the adjustments described above are applied to spark plugs with an insulator mark diameter of 9 mm or less. The insulator mark diameter of 9 mm corresponds to a spark plug in which the thread diameter of the mounting screw portion 52 of the metallic shell 50 is M12. Therefore, it is preferable to apply the adjustments described above to spark plugs in which the thread diameter of the mounting screw portion 52 of the metallic shell 50 is M12 or less. Particularly, it is preferable to apply the adjustments to spark plugs in which the thread diameter is M10 or less.

Modifications

The present invention is not limited to the examples and embodiments described above and can be implemented in various forms without departing from the spirit of the invention.

Modification 1: In the embodiments described above, the linear scale 540 is used to measure the moving distance of the crimping jig 530. However, a position sensor other than the linear scale may be used to measure the moving distance of the crimping jig 530. The moving distance of the crimping jig 530 may be determined without using any position sensor. For example, when the driving apparatus 510 uses a pulse motor (a stepping motor), the moving distance of the crimping jig 530 can be determined from the number of driving pulses of the pulse motor.

Modification 2: The present invention can be applied to spark plugs having various structures other than that shown in FIG. 1.

DESCRIPTION OF REFERENCE NUMERALS

3: ceramic resistor
4: seal
5: gasket
6: ring member
8: sheet packing
9: talc
10: insulator
11: corrugated portion
12: axial hole
13: leg portion
15: step portion
17: forward trunk portion
18: rear trunk portion
19: flange portion
20: center electrode
21: electrode base material
25: core
30: ground electrode
33: distal end
40: metallic terminal
50: metallic shell
51: tool engagement portion
51*f*: inclined surface
52: mounting screw portion
53: to-be-crimped portion
54: flange portion
56: step portion
58: to-be-buckled portion
59: screw neck
90: noble metal tip
100: spark plug
200: engine head
201: mounting screw hole
500: press
510: driving apparatus
520: load cell
530: crimping jig
532: curved portion
534: tapered surface
540: linear scale
550: control apparatus Having described the invention, the following is claimed:

1. A method for producing a spark plug which includes an insulator and a tubular metallic shell having a to-be-crimped portion at a rear end thereof and having a tool engagement portion and a to-be-buckled portion located forward of the to-be-crimped portion, the method comprising a crimping-pressing step of crimping the to-be-crimped portion using a crimping press, in a state in which the insulator is inserted into the metallic shell, to thereby fix the insulator and buckling the to-be-buckled portion, the method being characterized in that the crimping-pressing step includes:

(1) a step of bringing a crimping jig of the crimping press into contact with the to-be-crimped portion and moving the crimping jig forward such that a load acting on the crimping jig detected by a pressure sensor of the crimping press reaches a preset contact load, and (2) a buckling step of, after the step (1), further moving the crimping jig forward by a preset distance, then stopping the crimping jig, and maintaining the crimping jig in a stopped state, wherein a difference between a target moving distance of the crimping jig in a period in which the crimping jig having come into contact with the to-be-crimped portion moves until the crimping jig enters the stopped state and an actual moving distance of the crimping jig in that period is reduced by adjusting at least one of the preset contact load and the preset distance on the basis of at least one of a first overshoot amount by which the crimping jig moves excessively in the step (1) and a second overshoot amount by which the crimping jig moves excessively in the step (2).

2. A method for producing a spark plug according to claim 1, wherein the difference between the target moving distance and the actual moving distance is reduced by adjusting preset distance which is performed by subtracting, from the preset distance, at least one of a measured value or an estimated value of the first overshoot amount and an estimated value of the second overshoot amount.

3. A method for producing a spark plug according to claim 2, wherein the preset distance adjustment is performed by subtracting, from the preset distance, the estimated value of the first overshoot amount that is computed from past measured values of the first overshoot amount.

4. A method for producing a spark plug according to claim 2, wherein the estimated value of the first overshoot amount is an average value computed from past measured values of the first overshoot amount.

5. A method for producing a spark plug according to claim 2, wherein the estimated value of the first overshoot amount is determined from an actual moving speed of the crimping jig in the step (1) on the basis of a relation between the moving speed of the crimping jig when the crimping jig comes into contact with the to-be-crimped portion in the step (1) and past measured values of the first overshoot amount.

6. A method for producing a spark plug according to claim 2, wherein the preset distance adjustment is performed by subtracting, from the preset distance, the estimated value of the second overshoot amount that is computed from past measured values of the second overshoot amount.

7. A method for producing a spark plug according to claim 2, wherein the estimated value of the second overshoot amount is an average value of past measured values of the second overshoot amount.

8. A method for producing a spark plug according to claim 2, wherein the estimated value of the second overshoot amount is determined from an actual moving speed of the crimping jig in the step (2) on the basis of a relation between the moving speed of the crimping jig when the crimping jig buckles the to-be-buckled portion in the step (2) and past measured values of the second overshoot amount.

9. A method for producing a spark plug according to claim 1, wherein an estimated value of an overload acting on the crimping jig is determined on the basis of past measured values of the overload acting on the crimping jig, the overload corresponding to the first overshoot amount, and the difference between the target moving distance and the actual moving distance is reduced by adjusting contact load which is performed by subtracting the estimated value of the overload acting on the crimping jig from the preset contact load.

10. A method for producing a spark plug according to claim 9, wherein the estimated value of the overload acting on the crimping jig is an average value of the past measured values of the overload acting on the crimping jig, the overload corresponding to the first overshoot amount.

11. A method for producing a spark plug according to claim 9, wherein the estimated value of the overload acting on the crimping jig is determined from an actual moving speed of the crimping jig in the step (1) on the basis of a relation between the moving speed of the crimping jig when the crimping jig comes into contact with the to-be-crimped portion in the step (1) and the past measured values of the overload acting on the crimping jig, the overload corresponding to the first overshoot amount.

12. A method for producing a spark plug according to claim 1, wherein an outer diameter of the insulator at a rear end of the metallic shell is 9 mm or less.

* * * * *